US007824736B2

(12) United States Patent
Wang et al.

(10) Patent No.: US 7,824,736 B2
(45) Date of Patent: Nov. 2, 2010

(54) MICRO PATCH COATING DEVICE AND METHOD

(75) Inventors: An-Bang Wang, Taipei (TW); I-Chun Lin, Taipei (TW); Yi-Hua Wang, Taipei (TW); Chih-Kung Lee, Taipei (TW)

(73) Assignee: National Taiwan University, Taipei (TW)

( * ) Notice: Subject to any disclaimer, the term of this patent is extended or adjusted under 35 U.S.C. 154(b) by 798 days.

(21) Appl. No.: 11/806,094

(22) Filed: May 30, 2007

(65) Prior Publication Data

US 2008/0145537 A1 Jun. 19, 2008

(30) Foreign Application Priority Data

Dec. 15, 2006 (TW) ..... 95147343 A

(51) Int. Cl.

| | |
|---|---|
| ***B05B 7/08*** | (2006.01) |
| ***B05B 7/06*** | (2006.01) |
| ***B05D 1/26*** | (2006.01) |
| ***B05D 5/00*** | (2006.01) |
| ***B67D 7/52*** | (2010.01) |

(52) U.S. Cl. ..... 427/287; 118/313; 118/314; 118/411; 118/412; 222/145.3; 427/372.2; 427/426; 427/427.1; 427/427.2; 427/427.3

(58) Field of Classification Search ..... 427/426, 427/421.1, 427.1, 427.2, 427.3; 118/313, 118/314, 315

See application file for complete search history.

(56) References Cited

U.S. PATENT DOCUMENTS

| | | | | |
|---|---|---|---|---|
| 2005/0272159 | A1 * | 12/2005 | Ismagilov et al. | 436/34 |
| 2006/0096923 | A1 * | 5/2006 | Wagler et al. | 210/656 |
| 2006/0108012 | A1 * | 5/2006 | Barrow et al. | 137/806 |
| 2008/0129947 | A1 * | 6/2008 | Kim et al. | 349/156 |

* cited by examiner

*Primary Examiner*—Michael Cleveland
*Assistant Examiner*—Lisha Jiang
(74) *Attorney, Agent, or Firm*—Rosenberg, Klein & Lee

(57) ABSTRACT

A micro patch coating device includes a coating die with a micro channel structure. A coating fluid is supplied through a coating fluid inlet and an auxiliary fluid is supplied through an auxiliary fluid inlet. After a segment of a predetermined length of the coating fluid is formed at a two-phase fluid output section, the coating fluid flow is intercepted. In turn, a segment of predetermined length of the auxiliary fluid is formed at the two-phase fluid output section, and then the auxiliary fluid flow is intercepted. A two-phase fluid is formed and flows out of the coating die to the substrate to form micro patches thereon.

4 Claims, 9 Drawing Sheets

MICRO PATCH COATING DEVICE AND METHOD

FIELD OF THE INVENTION

The present invention relates to a coating device and method, and in particular to a micro patch coating device which can be applied in the fabrication of color filters of flat panel liquid crystal displays (LCD) and coloring unit of the fluorescent film in plasma display modules, or in the manufacturing of biomedical products and flexible electronics and cells.

BACKGROUND OF THE INVENTION

With the development of information technology, flat panel display has gradually replaced the conventional cathode ray tubes (CRT) display. Flat panel LCD, for instance, which takes up the largest market share among all flat panel displays, is composed of backlight source, light polarizer, glass substrate, liquid crystal, thin film transistor (TFT), color filter (CF), etc., while the color filter is the key component determining the color characteristics and contrast of a LCD.

Color filters in LCD and coloring unit for the fluorescent film in plasma display panel modules are the key components of the structures that convert black and white flat panel display into colorful ones. The coating structures of color filter for flat panel LCD, for instance, comprises a plurality of pixels of red (R), green (G) and blue (B) colors which are arranged in arrays on glass substrate, while a couple of pixels (normally three) correspond to one color dot on the display. When white light passes through the trichromatic pixels, it generates three primary colors of light, namely the red, green and blue light, which, by means of gray scale effect generated by the liquid crystal molecules, are further blended and form various colors.

The technologies for the fabrication of color filters can be classified into three types. The first coating type is photolithography method, which is the most frequently used technology currently. In the technology, uniform liquid films are coated to the substrate and defined patterns by photolithography method sequentially. This technology is applied to many methods including dyeing method, pigment dispersing method, electro-deposition, etc. Another type of technology is stamping, in which the patterns are respectively decided by stamps and impressed onto the substrate. The third type of technology is ink injection, in which miniscule droplets of ink are injected onto a substrate by ink injecting heads, allowing direct formation of micro patch patterns.

Referring to photolithography technology mentioned above, the prerequisite is to coat a liquid film uniformly. Currently, the most frequently used coating method is spin coating (as disclosed in U.S. Pat. No. 4,451,507). However, due to low material utility rate, the method has recently been phased out by other developments, such as extrusion spin coating (as disclosed in U.S. Pat. No. 6,191,053) and slot patch coating (as disclosed in U.S. Pat. No. 4,938,994). Both inventions aim to improve the material utility rate to allow the formation of uniform liquid film. The difference among the various methods, the dyeing method, pigment dispersing method and electro-deposition, lies in that the coating liquid film materials have different characteristics and accordingly specific operation procedures are applied.

The conventional dyeing method (as disclosed in U.S. Pat. No. 4,744,635) processes a dye absorbing layer made from transparent organic photosensitive material by photolithography and etching to form a pattern. The dye absorbing layer is immersed in a dyeing solution. Then, the display is exposed, dyed, baked and resist dyed to finish. The operation procedures are repeated for three cycles to obtain of three layers of color pattern, the red, green and blue colors. The method is not only too complicated, but also demands the installation of expensive equipment. Besides, because of the poor resistance of dyes against heat and light, the dyeing method is limited to apply for fabrication of small sized colorful LCD and conventional CRT.

Conventional pigment dispersing method (as disclosed in U.S. Pat. Nos. 5,085,973 and 4,786,148) is the most popular method used in manufacturing color filters currently. Photosensitive and thermosetting pigments are used. The procedures comprise coating coloring material to the mask on the glass substrate, and exposure imaging, baking, etc. to produce monochromatic micro-imaged color patch. Three cycles of operation procedures are required to produce trichromatic RGB pixels. The pigment dispersing method is complicated and requires expensive equipment and the operation is time-consuming, and it has low utility rate of coloring material and limited variation in pixel pattern, and therefore this method is not potential to meet the future demands for larger size and lower price display panel.

Known electro-deposition (as disclosed in U.S. Pat. No. 4,522,691) includes generating a patterned and transparent conductive film on a glass substrate and coating the coloring materials thereon by electrophoresis. Similarly, three cycles of the operation procedures are required to produce the patterns in RGB colors. The method also includes photolithography process. Hence, a number of operation parameters are involved, making it difficult to control the yield rate accurately. The inclusion of an additional transparent conductive film set forth by this method is the most significant drawback, as it lowers the light permeability and resolution, and hence it limits the layout of the patterns which cannot be too elaborate.

To conclude, the conventional coating technology fails to define patterns directly at coating, and it relies, instead, on exposure to remove excessive materials. Thus, it results in low material utility rate throughout the whole process, e.g. less than one third of the material, failing to satisfy the needs for mass production and at low costs.

A manufacturing method using stamping is disclosed in Taiwan Patent No. 00535010. A stamp with protruded blocks is stained with dyeing materials and the stamp is pressed to define a micro-structure pattern on a transparent insulating substrate which is then baked. The procedures are repeated three times to produce patterns with RGB color blocks. Despite of the advantages of high material utility rate and low manufacturing cost, this method provides limited variation of patterns, making it difficult to change the arrangement of the arrays of pixels at liberty.

An ink injection method is taught in Taiwan Patent No. 00512242. The ink injection method allows direct control on the positioning of ink injecting head module for defining patterns. The procedures of the method are as follows: coating a layer of absorbing film on a glass substrate to secure the absorption of the ink droplets to the glass substrate; next, allowing the ink injecting head module to directly spray the RGB color ink droplets onto the glass substrate to define the patterns required. This ink injection method has solved the problem of low material utility rate encountered in the conventional spin coating and photolithography, allowing higher extent of pattern variation than the stamping method.

However, since the ink injection method basically forms a line or surface pattern by a numerous dots, each droplet must be injected with extremely high accuracy into a block of a few microns or even smaller dimension. Besides, the traveling paths of droplets are susceptible to air flow disturbance, and it is likely that the ink droplets are injected accidentally to adjacent blocks and results in contamination. Therefore, a high precision machine is required. Also, the moving rate of the ink injecting head module is limited to secure precise injection. This can be what holds up the application of the method in industry. Because each of ink injecting heads is allowed to jet only one droplet at one time, the production efficiency is very low. In order to solve this problem, the numbers of the ink injecting heads have to be increased (which inevitably increase the cost). Besides, when ink injections are taking place in parallel movements, all ink injecting heads have to be in good condition without any clogging or abnormal situation. When the ink injection method is applied in large sized display panels, an enlarged dimension of machine is used. It should be careful to maintain good machine mobility and coating uniformity. These problems are yet to be solved in the future when large dimension TV displays will become the major products.

Thus, it is desired to develop a coating method that is simple in operation, has good yield rate and is economical for application.

SUMMARY OF THE INVENTION

A primary object of the present invention is to provide a micro patch coating device to overcome the drawbacks of above-mentioned conventional methods. In the present invention, at least one coating fluid and at least one auxiliary fluid are conveyed into a coating die comprising a micro channel structure, generating a two-phase fluid having alternate arrangement of the coating fluid and the auxiliary fluid. The coating die is driven to move along a direction in parallel to a substrate and injects the two-phase fluid directly on the substrate at predetermined locations and forms micro patches.

Another object of the present invention is to provide a slit coating method for generating discontinuous pattern. The coating method comprises a fluid generator which alternatively intercepts the supply of a coating fluid and that of an auxiliary fluid. By moving the coating die or the substrate and coating the two-phase fluid on the substrate, micro patches are formed on the substrate.

To fulfill the above objects, the present invention provides a device and a method for micro patch coating. The micro patch coating device comprises a coating die with a micro channel structure. A coating fluid is supplied through a coating fluid inlet and an auxiliary fluid is supplied through an auxiliary fluid inlet. After a segment of a predetermined length of the coating fluid is formed at a two-phase fluid output section, the coating fluid flow is intercepted. In turn, a segment of predetermined length of the auxiliary fluid is formed at the two-phase fluid output section, and then the auxiliary fluid flow is intercepted. A two-phase fluid is formed and flows out of the coating die to the substrate to form micro patches thereon.

The coating method in the present invention overcomes the low material utility rate problem happened in spin coating and photolithography, and is applicable in coating larger dimension display panels. The present invention also solves the problems of low yield rate and low production efficiency in ink injection method, and it allows high degree of variation of the pattern which cannot be achieved by stamping. The method of the present invention lowers the manufacturing costs, improves the production efficiency, and is capable to be used for producing larger dimension display panels and sophisticated micro patch patterns for matching the future development.

Furthermore, the present invention provides higher material utility rate than that of photolithography that requires repeated exposure procedures. The present invention saves the processing time. In the coating method of the present invention, coating patterns are formed by varying the output ratio of the coating and auxiliary fluid and the relative movements between the coating die and the substrate. Besides, by directly coating the two-phase fluid to the substrate, the pattern is easily changed than that produced by stamping. Meanwhile, the method does not require of high precision injection as that as required in conventional ink injecting and enables higher yield rate in production.

BRIEF DESCRIPTION OF THE DRAWINGS

The present invention will be apparent to those skilled in the art by reading the following description of embodiment thereof, with reference to the attached drawings, in which.

DETAILED DESCRIPTION OF THE PREFERRED EMBODIMENTS

Figure 1:
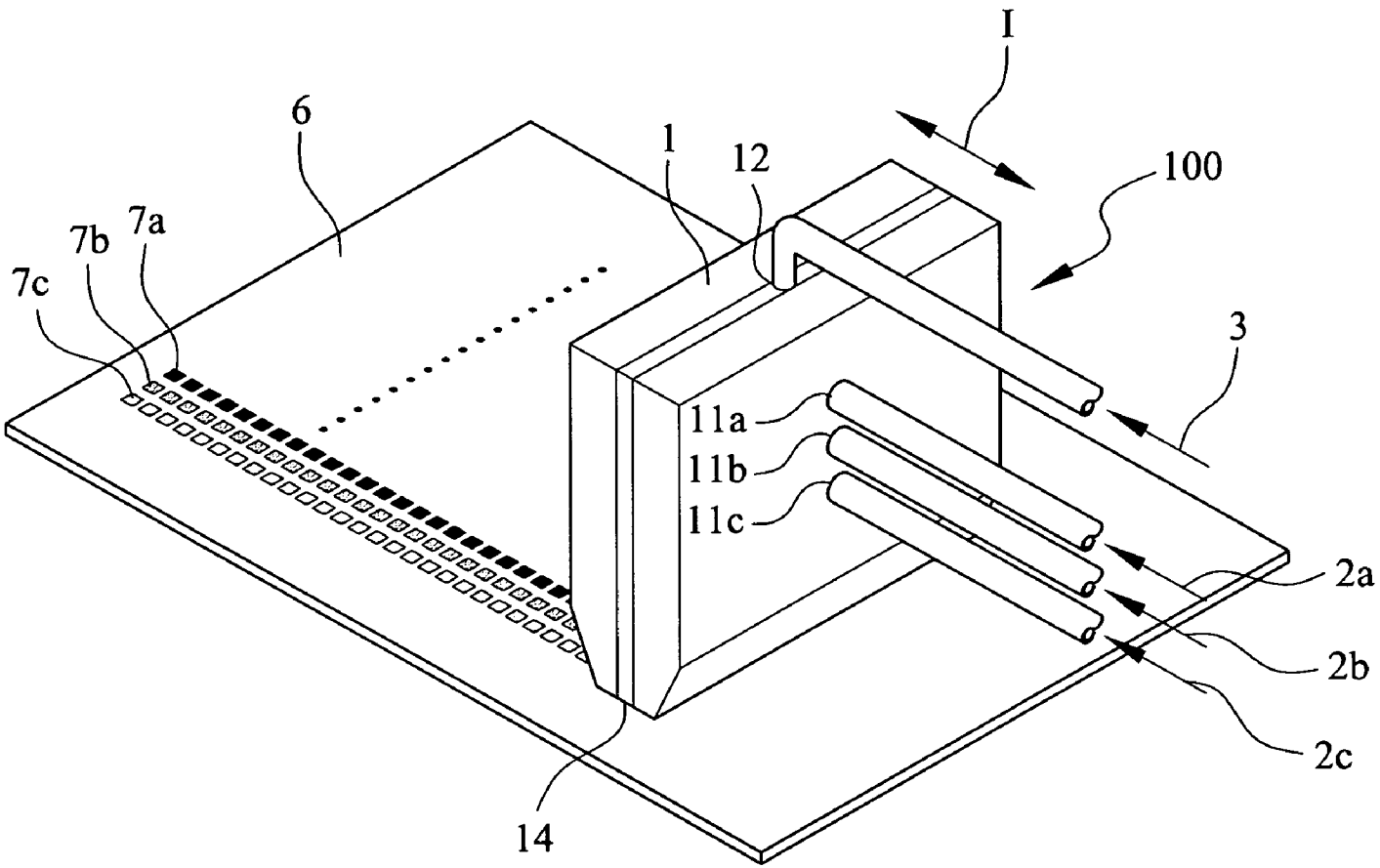
FIG. 1 is a schematic view of a coating embodiment of a micro patch coating device constructed in accordance with the present invention.
Figure 2:
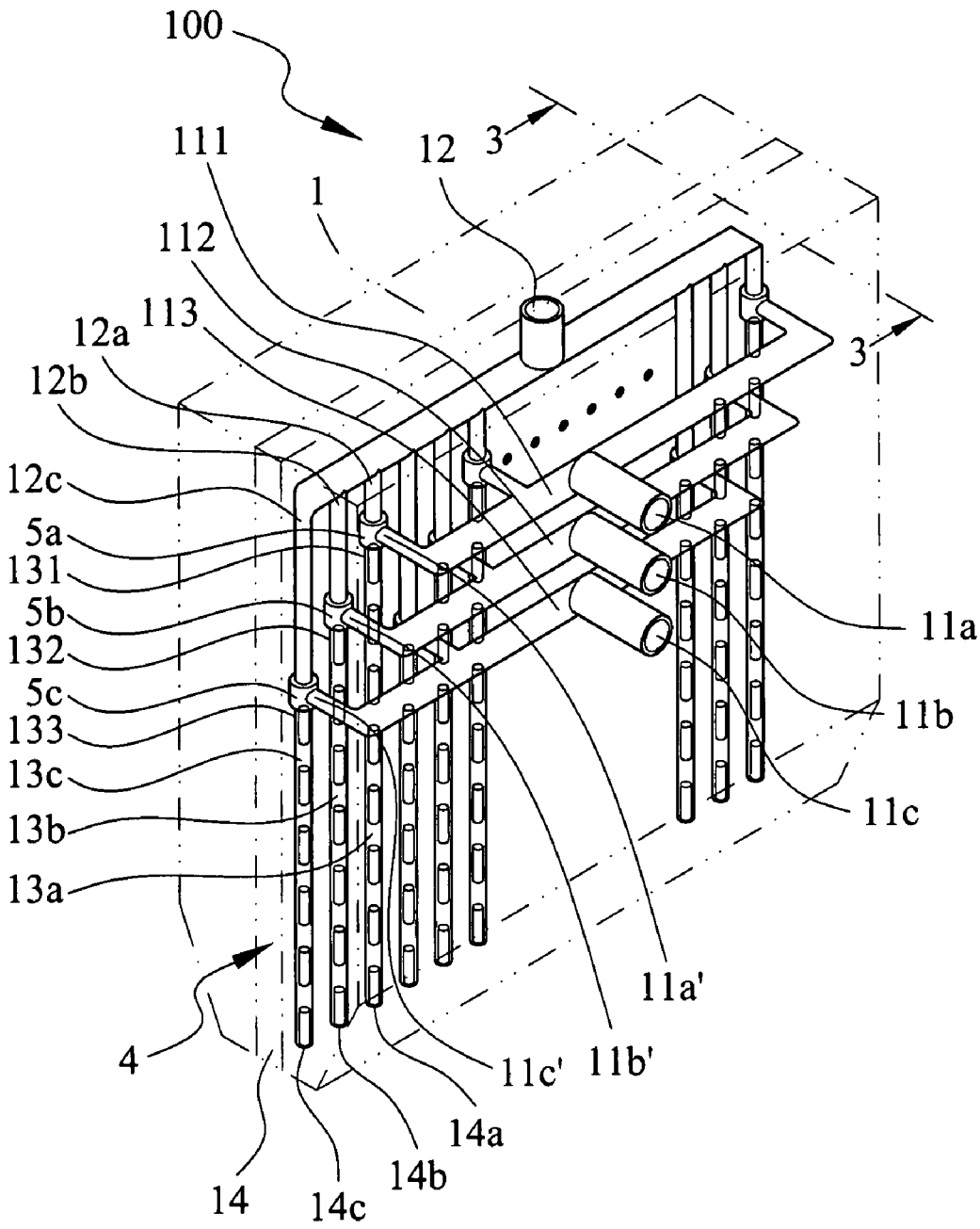
FIG. 2 is a schematic view showing a micro channel structure of a coating die of the micro patch coating device of FIG. 1.
Figure 3:
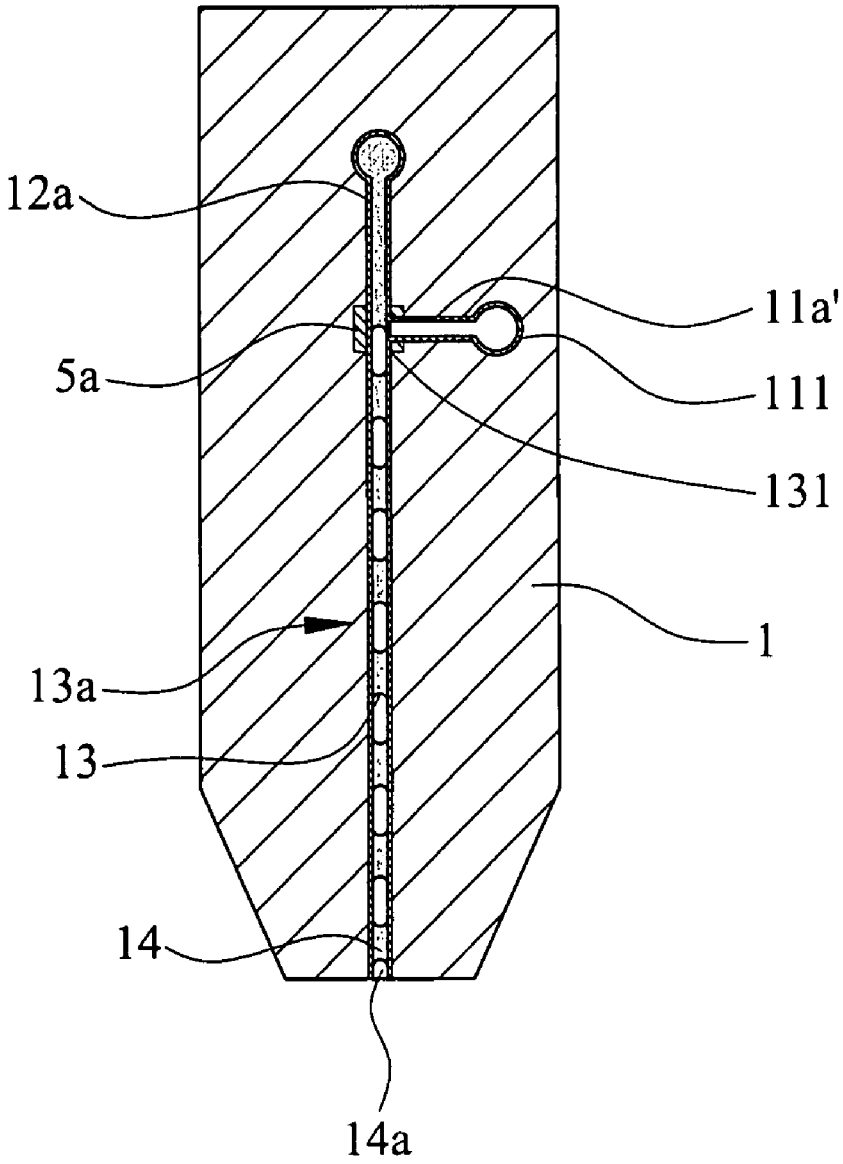
FIG. 3 is a cross-sectional view taken along line 3-3 of FIG. 2.

With reference to the drawings and in particular to FIGS. 1 to 3, a micro patch coating device 100 constructed in accordance with the present invention is shown, which comprises a coating die 1. The coating die 1 comprises a plurality of coating fluid inlets 11*a*, 11*b*, 11*c* and an auxiliary fluid inlet 12 arranged at specific positions. The coating fluid inlets 11*a*, 11*b*, 11*c* are used for respectively supplying coating fluids 2*a*, 2*b*, 2*c* into the coating die 1. Each of the coating fluids 2*a*, 2*b*, 2*c* contains a specific pigment, e.g. blue, green or red color pigment, which is different from each other and has specific composition. The auxiliary fluid inlet 12 is used for supplying an auxiliary fluid 3 to the coating die 1. The auxiliary fluid 3 may comprise a single fluid or a number of different fluids, based on the types of the coating fluids.

As shown in FIG. 2, the coating die 1 is provided with a micro channel structure 4 arranged at an interior of the coating die 1. The bottom of the coating die 1 is formed with fluid outlets 14. The coating fluid inlets 11*a*, 11*b*, 11*c* and the auxiliary fluid inlet 12 are connected to the micro channel structure 4, respectively.

The micro channel structure 4 comprises a plurality of coating fluid buffering sections 111, 112, 113, a plurality of coating fluid passages 11*a*′, 11*b*′, 11*c*′, a plurality of auxiliary fluid passages 12*a*, 12*b*, 12*c* and a plurality of two-phase fluid output sections 13*a*, 13*b*, 13*c*.

Each of the coating fluid buffering sections 111, 112, 113 is connected to a coating fluid inlet 11*a*, 11*b*, 11*c*. The coating fluid buffering sections 111, 112 and 113 are arranged between the coating fluid inlets 11*a*, 11*b*, 11*c* and the coating fluid passages 11*a*′, 11*b*′, 11*c*′. The coating fluids 2*a*, 2*b*, 2*c* are respectively supplied from the coating fluid inlets 11*a*, 11*b*, 11*c* through the coating fluid buffering sections 111, 112, 113 to the coating fluid passages 11*a*′, 11*b*′, 11*c*′. The auxiliary fluid passages 12*a*, 12*b*, 12*c* are connected to the auxiliary fluid inlet 12.

The diameter of the coating fluid passage 11*a*′, 11*b*′, 11*c*′ is smaller than that of the coating fluid buffering sections 111, 112, 113, while the diameter of the coating fluid buffering sections 111, 112, 113 is identical to that of the coating fluid inlets 11*a*, 11*b*, 11*c*. A two-phase fluid generator 5*a*, 5*b*, 5*c* is arranged at a junction between the coating fluid passage 11*a*′, 11*b*′, 11*c*′ and the corresponding auxiliary fluid passage 12*a*, 12*b*, 12*c*.

Each of the two-phase fluid output sections 13*a*, 13*b*, 13*c* comprises a two-phase fluid inlet 131, 132, 133 at one end and a two-phase fluid outlet 14*a*, 14*b*, 14*c* at the other end. The two-phase fluid inlets 131, 132, 133 are respectively connected to the two-phase fluid generators 5*a*, 5*b*, 5*c* for conveying the two-phase fluids 13 generated by the two-phase fluid generators 5*a*, 5*b*, 5*c*. The two-phase fluid outlets 14*a*, 14*b*, 14*c* are arranged at the bottom of the coating die 1 and kept at a predetermined distance from the surface of the substrate 6, such that the two-phase fluids 13 flow from the two-phase fluid output sections 13*a*, 13*b*, 13*c* out through the fluid outlets 14 of the coating die 1.

In practical applications, the auxiliary fluid 3 may comprise a liquid or a gas immiscible with the coating fluids 2*a*, 2*b*, 2*c*. After flowing out of the fluid outlet 14 of the coating die 1, the two-phase fluid 13 are coated at predetermined locations of the substrate 6 by the movement of the coating die 1 and/or the substrate 6 along a parallel direction relative to each other. In the case a gas is used as the auxiliary fluid, micro patches 7*a*, 7*b*, 7*c* are directly formed on the substrate. In the case a liquid that is immiscible with the coating fluids 2*a*, 2*b*, 2*c* is used as the auxiliary fluid 3, the substrate 6 is heated to vaporize the auxiliary fluid 3 by baking, leaving the coating fluid 2*a*, 2*b*, 2*c* to form the micro patches 7*a*, 7*b*, 7*c*.

Figure 4:
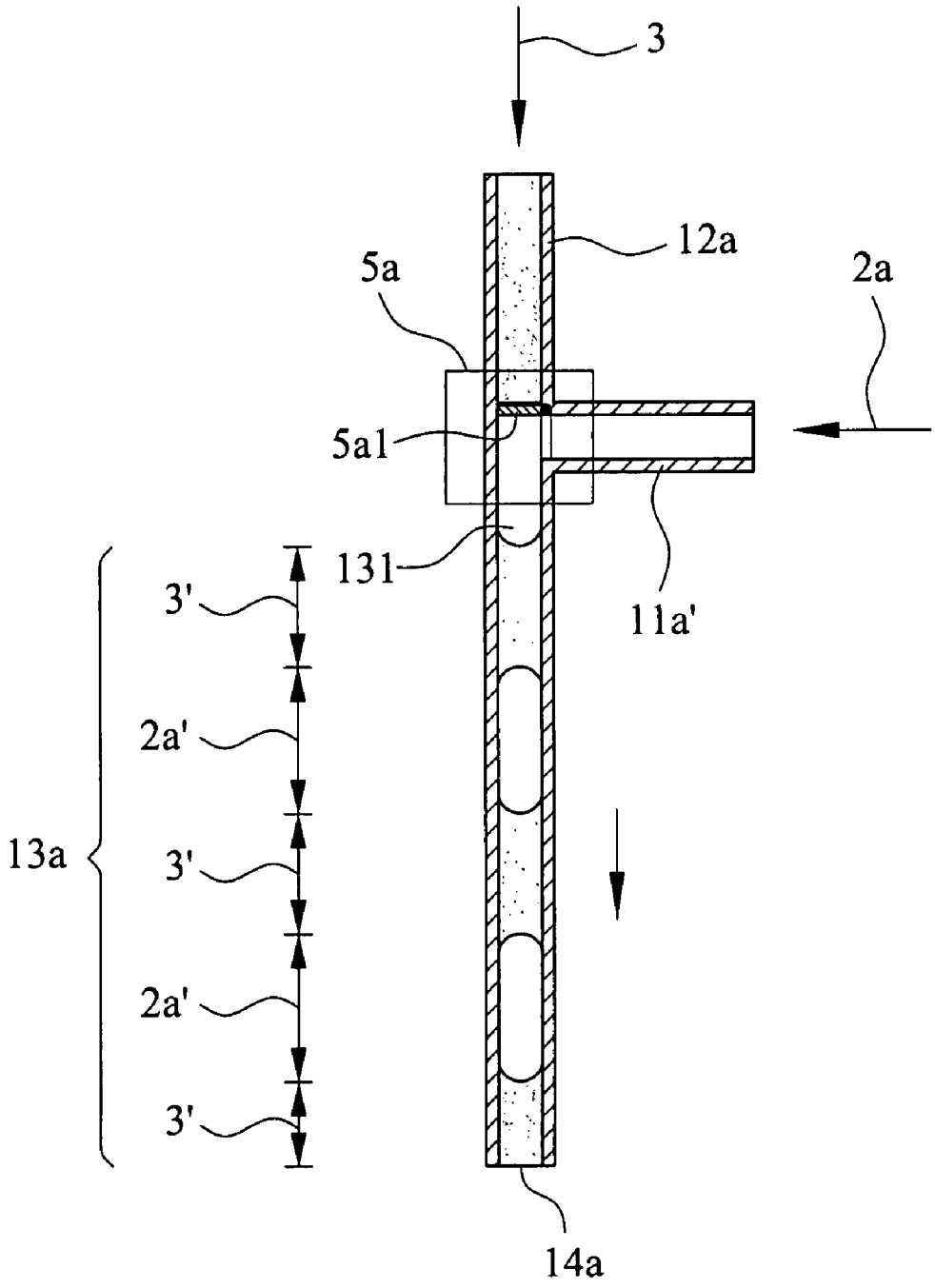
FIG. 4 is a schematic view showing the generation of a two-phase fluid by a flow generator of the micro patch coating device.

Please refer to FIG. 4 which is a schematic view showing the generation of the two-phase fluid by the two-phase flow generator of the micro patch coating device. The two-phase fluid generator 5*a* is arranged at the junction between the coating fluid passage 11*a*′ and the auxiliary fluid passage 12*a*. The two-phase fluid generator 5*a* comprises an interceptor 5*a*1. The interceptor 5*a*1 may comprise a valve or it can be a valveless type which is capable to achieve the same functions.

The coating fluids 2*a* are delivered through the coating fluid inlet 11*a* to the coating fluid buffering section 111 and then to the coating fluid passage 11*a*′. The auxiliary fluid 3 is delivered from the auxiliary fluid inlet 12 to the auxiliary fluid passage 12*a*. After a predetermined amount of the coating fluid 2*a* flows through the interceptor 5*a*1 to generate a segment 2*a*′ of a predetermined length in the two-phase fluid output section 13*a*, the interceptor 5*a*1 intercepts the flowing of the coating fluid 2*a*. In turn, the intercepted 5*a*1 allows the auxiliary fluid 3 to flow from the auxiliary fluid passage 12*a*. After a predetermined amount of the auxiliary fluid 3 flows through the interceptor 5*a*1 to generate a segment 3' of a predetermined length in the two-phase fluid output section 13*a*, the interceptor 5*a*1 intercepts the flowing of the coating fluid 2*a*. The interception actions of the interceptor 5*a*1 to the coating fluid flow and to the auxiliary fluid flow are proceeded alternatively, forming a two-phase fluid 13 in the two-phase fluid output sections 13*a*. The auxiliary fluid 3 remains immiscible with the coating fluid 2*a*, which is respectively represented by sections 3' and 2*a*' in the two-phase output fluid 13*a*.

In the embodiment mentioned above, the two-phase fluid generators are arranged in the micro channel structure 4 inside the coating die 1, forming the two-phase fluid. In practical application, the two-phase fluid generators may be arranged at an exterior of the coating die 1 for forming the two-phase fluid just as well.

Figure 5:
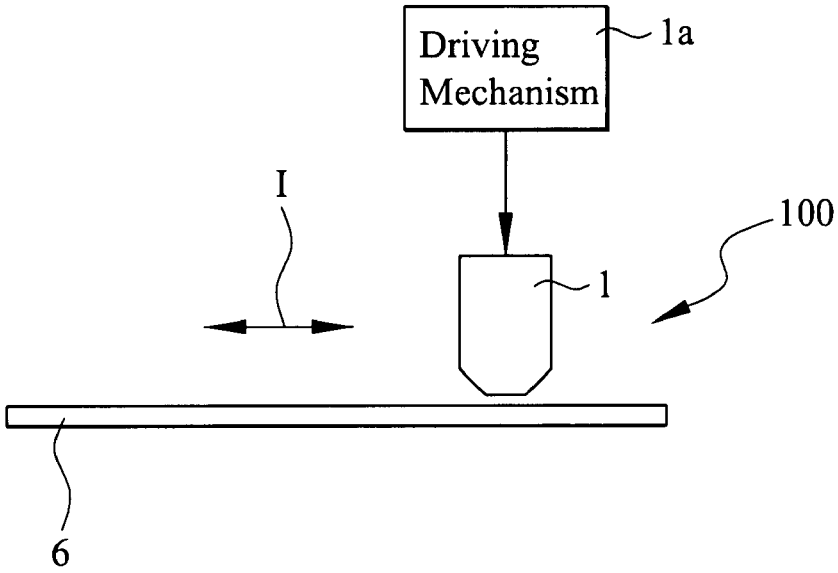
FIG. 5 is a schematic view showing a movement of the coating die driven by a driving mechanism of the micro patch coating device.

As shown in FIG. 5 which is a schematic view showing a movement of the coating die driven by a driving mechanism of the micro patch coating device, the coating die 1 of the micro patch coating device 100 is located at a predetermined distance above the substrate 6. The coating die 1 is driven by a driving mechanism 1*a* to move back and forth along a horizontal direction I which is parallel to the substrate 6. Thus, it allows the coating die 1 to displace relatively to the substrate 6 when performing the coating procedures. The driving mechanism 1*a* may comprise a platform conveying device with adjustable speed that allows the regulation of the displacement velocity of the coating die 1.

Figure 6:
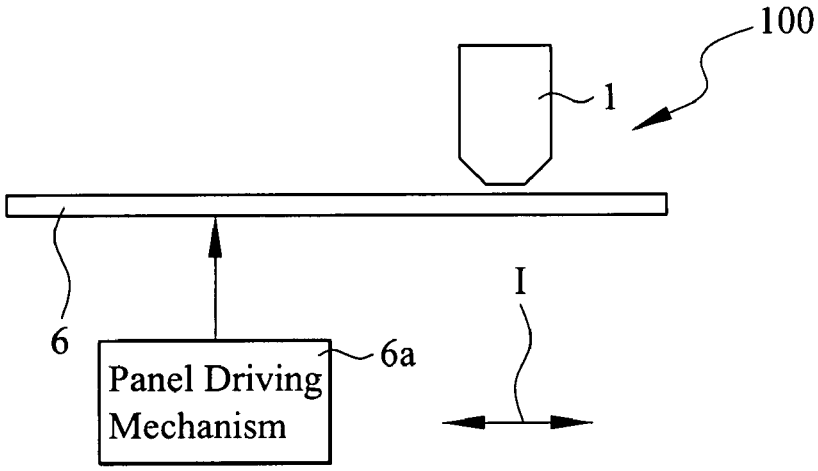
FIG. 6 is a schematic view showing a movement of the substrate driven by a panel driving mechanism of the micro patch coating device.

Please refer to FIG. 6. FIG. 6 is a schematic view showing a movement of the substrate driven by a panel driving mechanism of the micro patch coating device. The substrate 6 is located at a predetermined distance below the coating die 1 of the coating device 100. The substrate 6 is driven by a panel driving mechanism 6*a* to move back and forth along a horizontal direction I which is parallel to the coating die 1. Thus it allows the substrate 6 to displace relatively to the coating die 1 when performing the coating procedures. The panel driving mechanism 6*a* may comprise a platform conveying device with adjustable speed that allows the regulation of the displacement velocity of the substrate 6.

Furthermore, both the driving mechanism 1*a* and the panel driving mechanism 6*a* may be used at the same time. The driving mechanism 1*a* drives the coating die 1 to move and the panel driving mechanism 6*a* drives the substrate 6 to move simultaneously along a horizontal direction I to allow parallel and opposite movements. In this way, the coating procedure is speeded up for improving the production efficiency. In practical application, if the auxiliary fluid 3 is a gas, either the coating die 1 or the substrate 6 may be driven to move both in a direction perpendicular to the surface of the substrate 6 of FIG. 5 and in a horizontal direction, so as to generate different arrangements of arrays of pixels.

Figure 7:
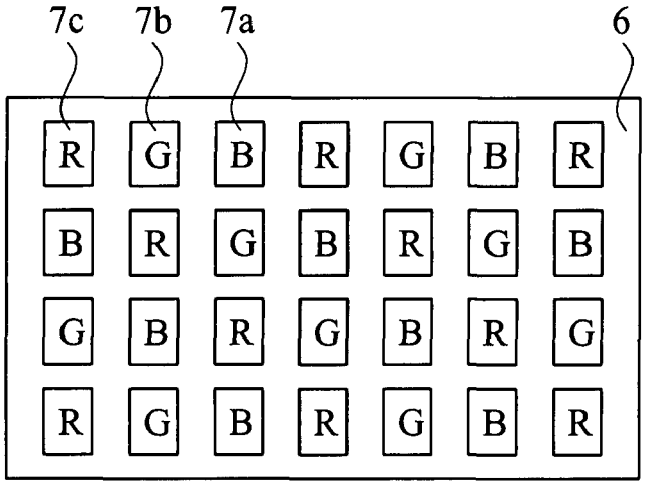
FIG. 7 is a schematic view showing a coating pattern formed on the substrate by the micro patch coating device of the present invention.
Figure 8:
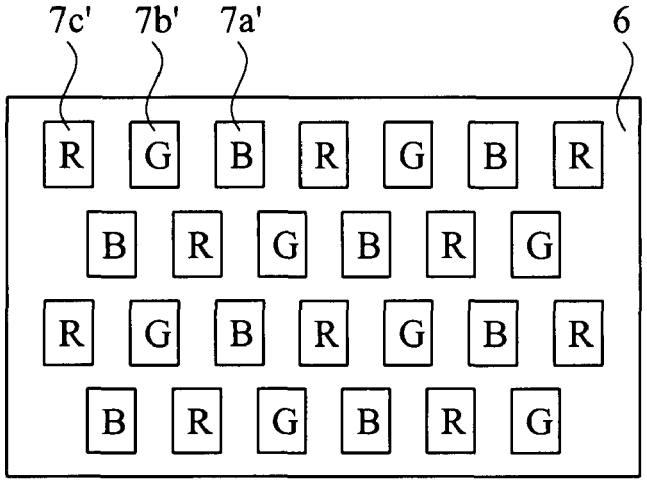
FIG. 8 is a schematic view showing another coating pattern formed on the substrate by the micro patch coating device of the present invention.

FIG. 7 is a schematic view showing a coating pattern formed on the substrate and FIG. 8 is a schematic view showing another coating pattern formed on the substrate. When the two-phase fluids 13 flow out of the fluid outlet 14 of the coating die 1, the two-phase fluids 13 are coated at predetermined locations on the substrate 6 by means of the parallel and opposite movements of the coating die 1 and the substrate 6, and form a plurality of micro patches 7*a*, 7*b*, 7*c* in FIGS. 7 and 7*a*', 7*b*', and 7*c*' in FIG. 8. Since the coating fluids 2*a*, 2*b* and 2*c* contains a specific pigment, e.g. blue, green or red color pigment, which is different from each other and has specific composition, the micro patches 7*a*, 7*b*, 7*c* are formed with the blue, green and red color in a sequence, forming pixels in the form of rectangular matrix.

In the case when the auxiliary fluid 3 is a gas, either the coating die 1 and the substrate 6 can also be arranged to move in a direction perpendicular to the surface of the substrate 6 of FIG. 5, in order to generate different arrangements of arrays of pixels, as shown in FIG. 8.

Figure 9:
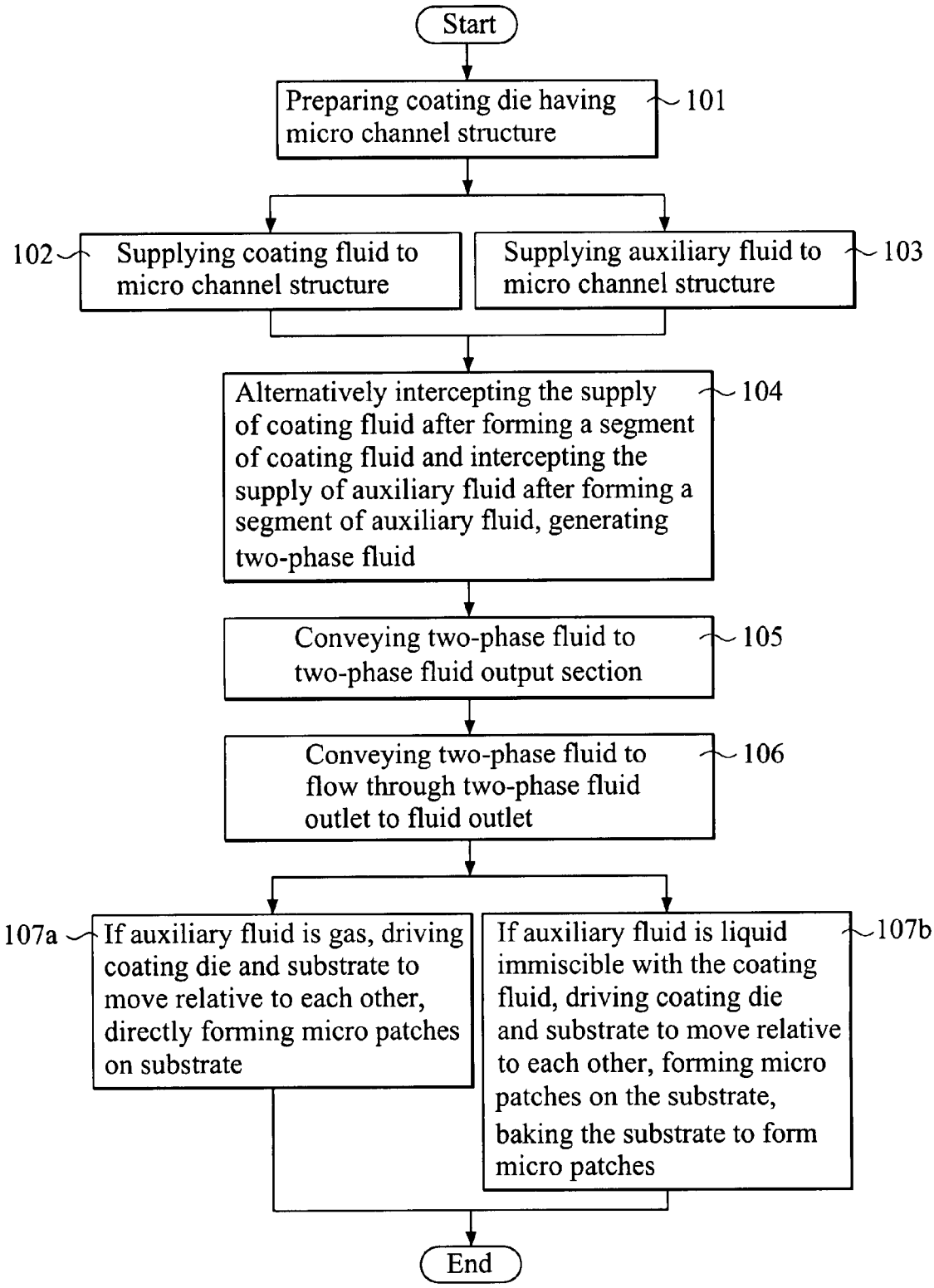
FIG. 9 is a flow chart for performing a micro patch coating method in accordance with the present invention.

FIG. 9 is a flow chart for performing a micro patch coating method in accordance with the present invention. Firstly, a coating die is prepared in step 101. The coating die comprises a micro channel structure with at least one coating fluid inlet, at least one auxiliary inlet, at least one two-phase fluid output section and at least one fluid outlet.

After the coating die is prepared, a coating fluid is supplied to the micro channel structure of the coating die from the coating fluid inlet at step 102. An auxiliary fluid is supplied to the auxiliary fluid inlet of the micro channel structure at step 103.

The flowing of the coating fluids and the flowing of auxiliary fluid are alternatively intercepted by a two-phase fluid generator (Step 104), generating a two-phase fluid comprising a segment of coating fluid of a predetermined length and a segment of auxiliary fluid of a predetermined length.

In step 105, the two-phase fluid are conveyed to the two-phase fluid output section, and then flows through the two-phase fluid outlet of the fluid output section to the fluid outlet of the coating die at step 106.

Lastly, the coating die and the substrate are allowed to move in parallel and opposite direction, allowing the two-phase fluids to flow out of the coating die and coat at predetermined locations on the substrate, defining micro patches directly at step 107*a* in the case that the auxiliary fluid is a gas. In the case that the auxiliary fluid is a liquid immiscible with the coating fluid, the substrate is heated to vaporize the auxiliary fluid by baking, leaving the coating fluid to define micro patches at step 107*b*.

Figure 10:
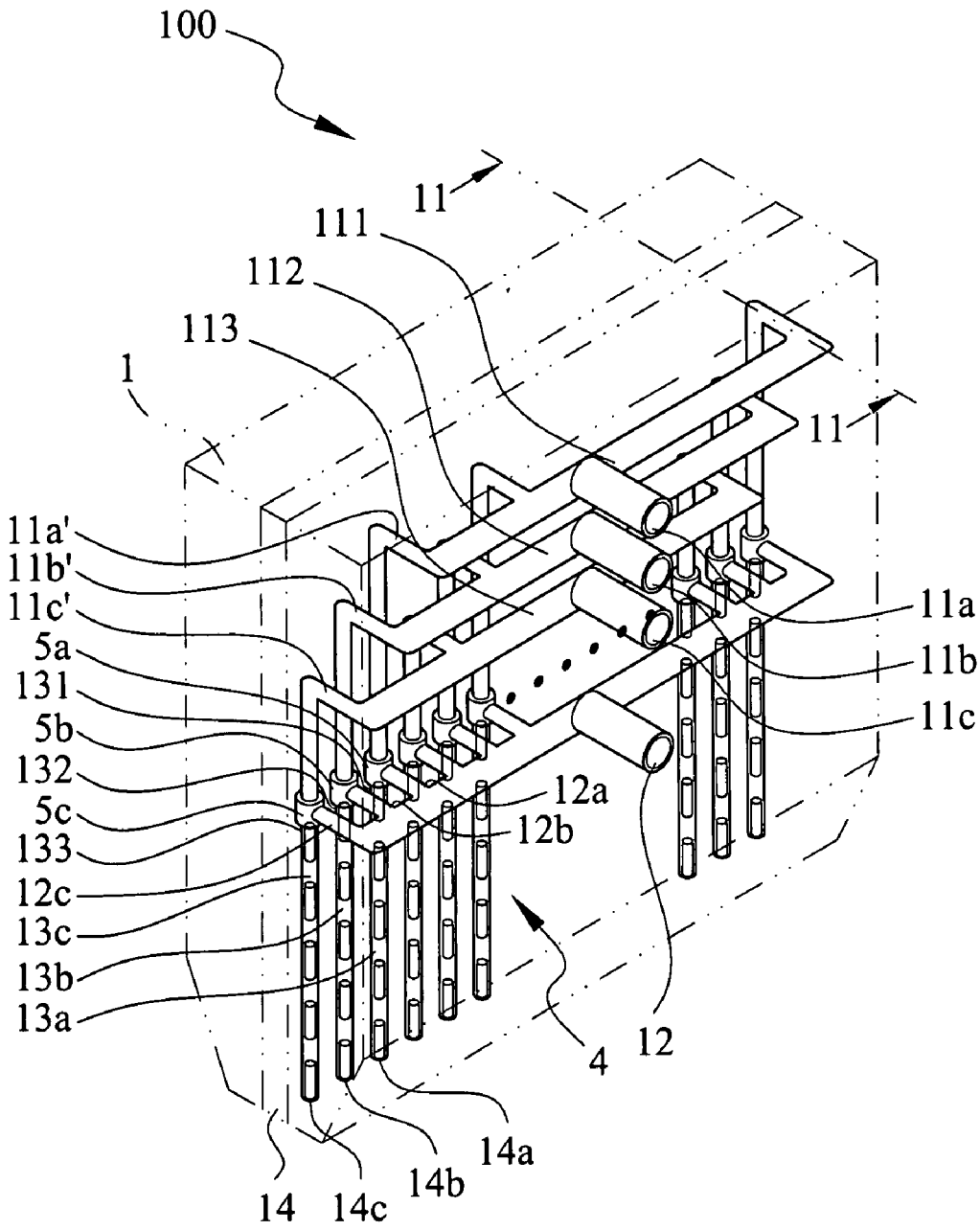
FIG. 10 is a schematic view showing a micro channel structure of a coating die of a second embodiment of a micro patch coating device constructed in accordance with the present invention.

FIG. 10 is a schematic view showing a micro channel structure of a coating die of a second embodiment of the present invention. The second embodiment is similar to the first embodiment and same reference numbers are used for identical components. The difference between the second embodiment and the first embodiment is that the auxiliary fluid inlet 12 is arranged below the coating fluid inlets 11*a*, 11*b*, 11*c*. Also, the auxiliary fluid passages 12*a*, 12*b*, 12*c* are arranged below the coating fluid passages 11*a*', 11*b*', 11*c*'.

Figure 11:
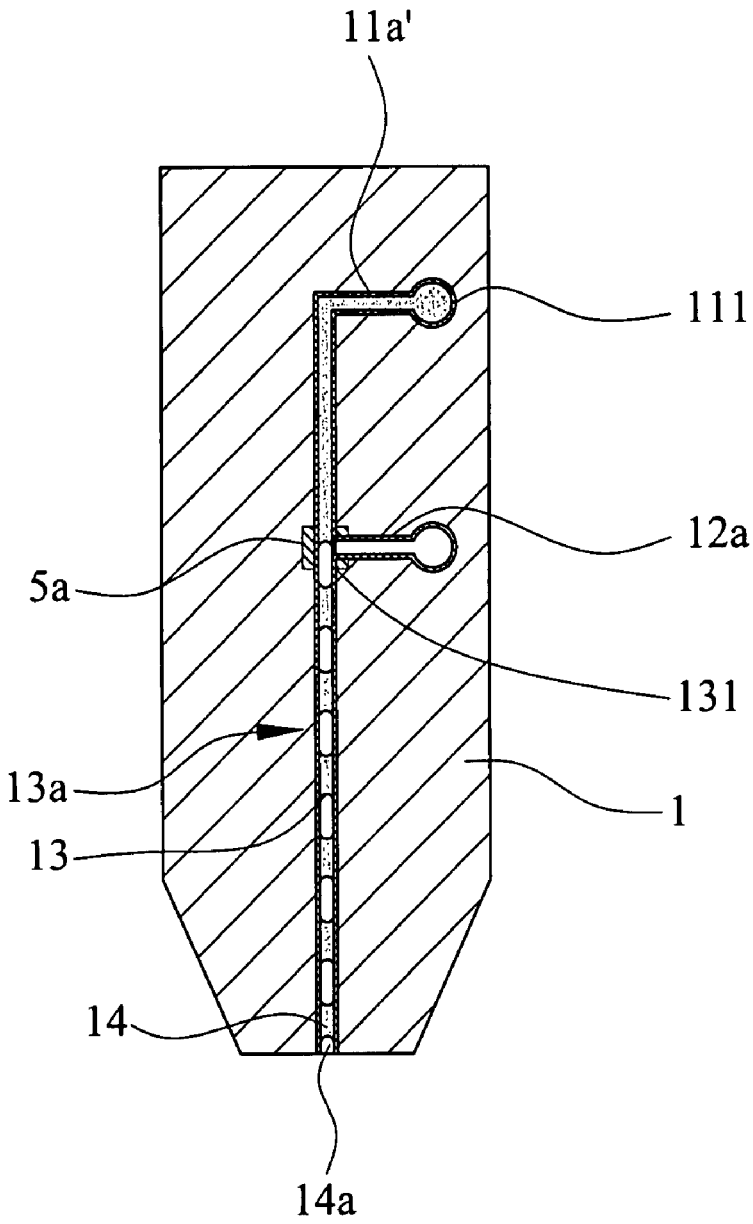
FIG. 11 is a cross-sectional view taken along line 11-11 of FIG. 10.

The coating fluid 2*a* flows from the coating fluid inlet 11*a*, through the coating fluid buffering section 111 and the coating fluid passage 11*a*' to the two-phase fluid generator 5*a*. The auxiliary fluid 3 flow from the auxiliary fluid inlet 12 and the auxiliary fluid passage 12*a* to the two-phase fluid generator 5*a*. As shown in FIG. 11, the two-phase fluid generator 5*a* allows the coating fluid 2*a* and auxiliary fluid 3 to alternatively flow and intercepted. In the two-phase fluid output section 13*a*, two-phase fluid 13 is formed. The two-phase fluid 13 flows through the two-phase fluid outlet 14*a* of the coating die 1.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A micro patch coating method, comprising:

(a) preparing a coating die having a micro channel structure which has at least one coating fluid inlet, at least one auxiliary fluid inlet, at least one two-phase fluid output section and at least one fluid outlet;

(b) supplying a coating fluid to the micro channel structure through the coating fluid inlet;

(c) supplying an auxiliary fluid to the micro channel structure through the auxiliary fluid inlet;

(d) alternatively intercepting the supply of coating fluid after a predetermined length of coating fluid is formed and intercepting the supply of the auxiliary fluid after a predetermined length of auxiliary fluid is formed, thereby generating a two-phase fluid;

(e) conveying the two-phase fluid to the two-phase fluid inlet in the two-phase fluid output section, through the two-phase fluid outlet of the two-phase fluid output section, and then out of the fluid outlet of the coating die; and (f) driving the coating die and the substrate to move in a movement relative to each other, such that the two-phase fluid flows out of the coating die and is coated on the substrate at predetermined locations and directly forming micro patches on the substrate in the case that the auxiliary fluid is a gas, or, by baking to form micro patches on the substrate in the case that the auxiliary fluid is a liquid immiscible with the coating fluid.

2. The micro patch coating method as claimed in claim 1, wherein the auxiliary fluid is a liquid or gas immiscible with the coating fluid.

3. The micro patch coating method as claimed in claim 1, wherein in step (f), the movement between the coating die and the substrate is achieved by displacing the coating die.

4. The micro patch coating method as claimed in claim 1, wherein in step (f), the movement between the coating die and the substrate is achieved by displacing the substrate.

* * * * *